United States Patent [19]

Graf

[11] 4,239,448

[45] Dec. 16, 1980

[54] HIGH PRESSURE PUMP FOR FLUID JET SLITTER

[75] Inventor: Edwin X. Graf, Beloit, Wis.

[73] Assignee: Beloit Corporation, Beloit, Wis.

[21] Appl. No.: 844,911

[22] Filed: Oct. 25, 1977

[51] Int. Cl.[3] ..... F04D 1/12

[52] U.S. Cl. ..... 415/89; 415/90

[58] Field of Search ..... 415/88, 89, 90

[56] References Cited

U.S. PATENT DOCUMENTS

| | | | |
|---|---|---|---|
| 810,975 | 1/1906 | Petersen | 415/89 |
| 1,377,914 | 5/1921 | Newbigin | 415/1 |
| 2,264,341 | 12/1941 | Sinclair et al. | 415/89 |
| 2,289,440 | 7/1942 | Kugel | 415/89 |
| 2,426,321 | 8/1947 | Montrose | 417/201 |
| 2,492,456 | 12/1949 | Becker | 415/89 |
| 2,625,213 | 1/1953 | Smith et al. | 415/89 X |
| 3,004,495 | 10/1961 | Macklis | 415/89 |
| 3,123,861 | 3/1964 | Westover | 415/90 X |
| 3,218,982 | 11/1965 | Wigton | 415/89 |
| 3,357,361 | 12/1967 | Scott | 415/83 |
| 3,384,023 | 5/1968 | King et al. | 415/89 |
| 3,446,149 | 5/1969 | Amos et al. | 415/90 |
| 3,669,561 | 6/1972 | Mott | 415/90 |

*Primary Examiner*—Leonard E. Smith

*Attorney, Agent, or Firm*—Hill, Van Santen, Steadman, Chiara & Simpson

[57] ABSTRACT

A high-pressure liquid pump for small quantities of liquid such as water to be used in water cutting devices such as for continuously slitting a moving paper web with the pump having an outer annular shell driven in rotation and a pair of hydrodynamic shoes facing the shell with liquid delivery passages therethrough and the shell driven in rotation around the shoes and the shoes mounted on arms with hydraulic pressure members to force the shoes against the shell and control the output pressure of the pump.

3 Claims, 3 Drawing Figures

HIGH PRESSURE PUMP FOR FLUID JET SLITTER

BACKGROUND OF THE INVENTION

The present invention relates to improvements in very high-pressure, low-delivery liquid pumps particularly for waterjet cutting such as used in waterjet slitters for slitting a continual traveling web of paper.

Waterjet cutting is used in a variety of industries. It has been discovered that using a moving high-pressure stream of liquid for cutting affords advantages in that the liquid can be ordinary tap water without additives. The cutting operation is dust-free and does not create critical dust problems which result in creating wear in machinery, pollution of the air and health hazards. Waterjet cutting is advantageous in that it does not require space-consuming and complex cutting equipment, and the mechanism can be easily operated and controlled for a variety of cutting conditions with variations in speed and thickness of material and other variations which must be encountered in commercial cutting operations.

However, to provide a continuous supply of water in very small quantities at very high pressures such as used in paper web cutting, the reliable operating life of pumps now available is severely limited. Pressures in the range of 10,000 psi to 60,000 psi must be available at very small delivery quantities of water and such pumps frequently have a operating life on the order of only two hundred and fifty hours without requiring shutdown and attention. Further, such pumps require parts with critical tolerances and the moving parts must be carefully and precisely machined. Also, conventional pumps are generally mechanically very complex and many are unreliable in applications where the fluid is water and cannot contain rust inhibitors.

Accordingly, it is an object of the present invention to provide an improved pump for delivering a cutting fluid such as water in low volumes at very high pressures and is capable of doing so over long operating periods without attention to repair.

A still further object of the invention is to provide a very simplified pump structure requiring a minimum of moving parts and a minimum of machined parts with the parts not requiring critical tolerances for pumping liquid in very small volumes at very high pressures.

A still further object of the invention is to provide an improved rotary high-speed, high-pressure pump wherein the output pressure can be easily and readily controlled during operation, and where the number of contacting parts are reduced to a minimum to reduce operating wear.

A further object of the present invention is to provide a high-speed rotating high-pressure pump which is capable of an almost indefinite operating life because of the absence of contacting wearing parts.

Other objects, advantages and features will become more apparent, as will equivalent structures which are intended to be covered herein, with the teaching of the principles of the invention in connection with the disclosure of the preferred embodiments in the specification, claims and drawings, in which:

DRAWINGS

DESCRIPTION OF THE PREFERRED EMBODIMENTS

Figure 1:
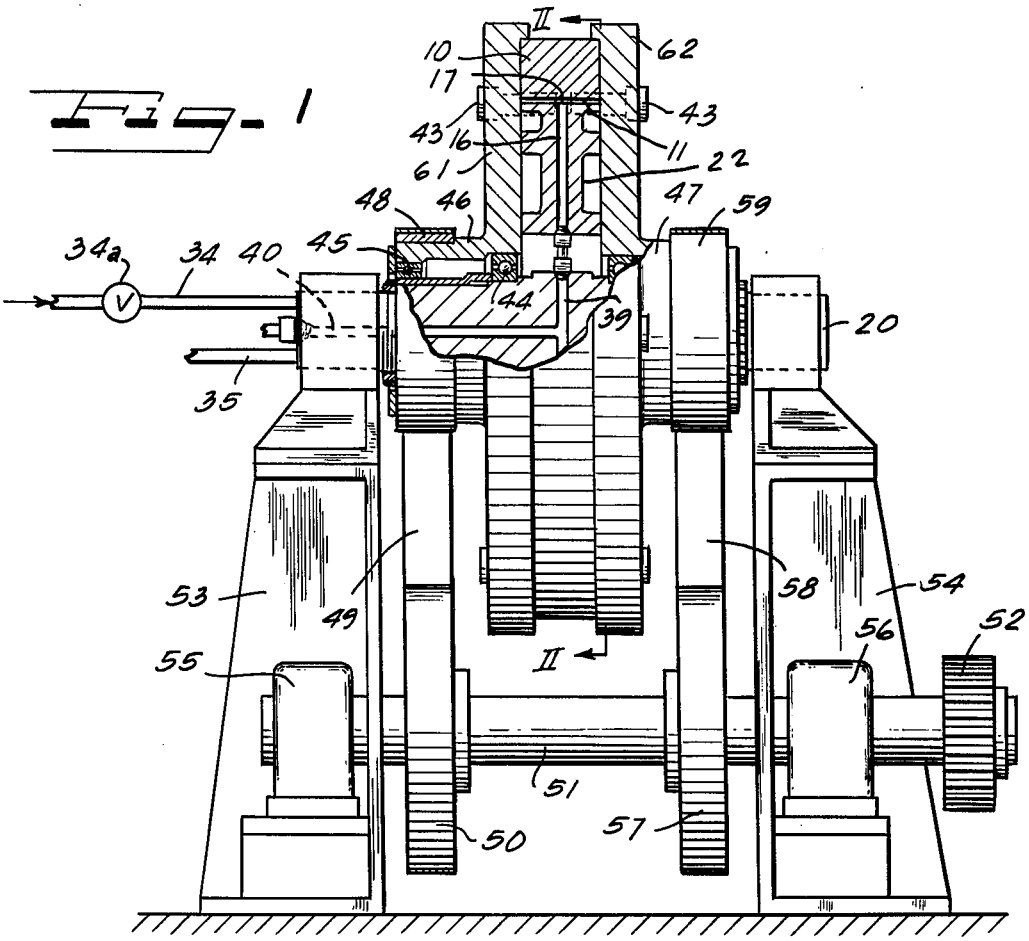
FIG. 1 is an elevational view with an upper portion shown in section taken through the axis of the mechanism, of a pump mechanism constructed and operating in accordance with the present invention illustrating the elements of structure of the pump which is located within the outer housing.
Figure 2:
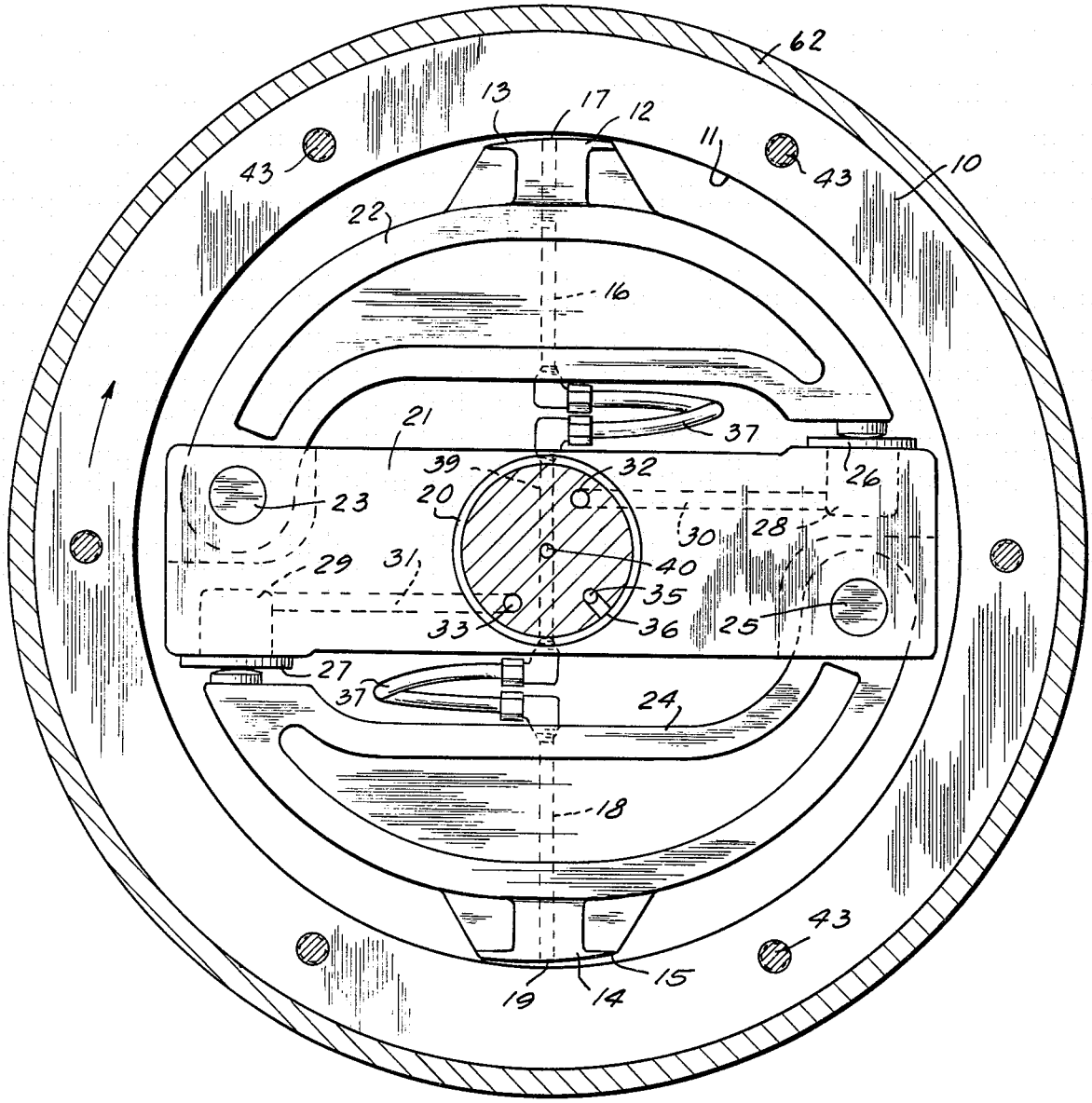
FIG. 2 is a vertical sectional view taken substantially along line II—II of FIG. 1.

As illustrated in FIGS. 1 and 2, the pump includes an annular pump shell ring 10 having a smooth inward annular facing surface 11.

As illustrated in FIG. 2, a hydrodynamic shoe 12 having a relieved leading edge 13 coacts with the smooth inner surface 11 by being in close running engagement with the surface 11 sufficiently close to build up a hydraulic wedge of fluid between the shoe and the relatively moving surface. A similar shoe 14, also having a relieved leading edge 15, is located at a position diametrically opposite the first shoe 12. The shoes in these locations balance the forces on the ring relative to the central axis of the ring. It will be understood, of course, that the mechanism will operate with a single shoe or with additional numbers of shoes.

Figure 3:
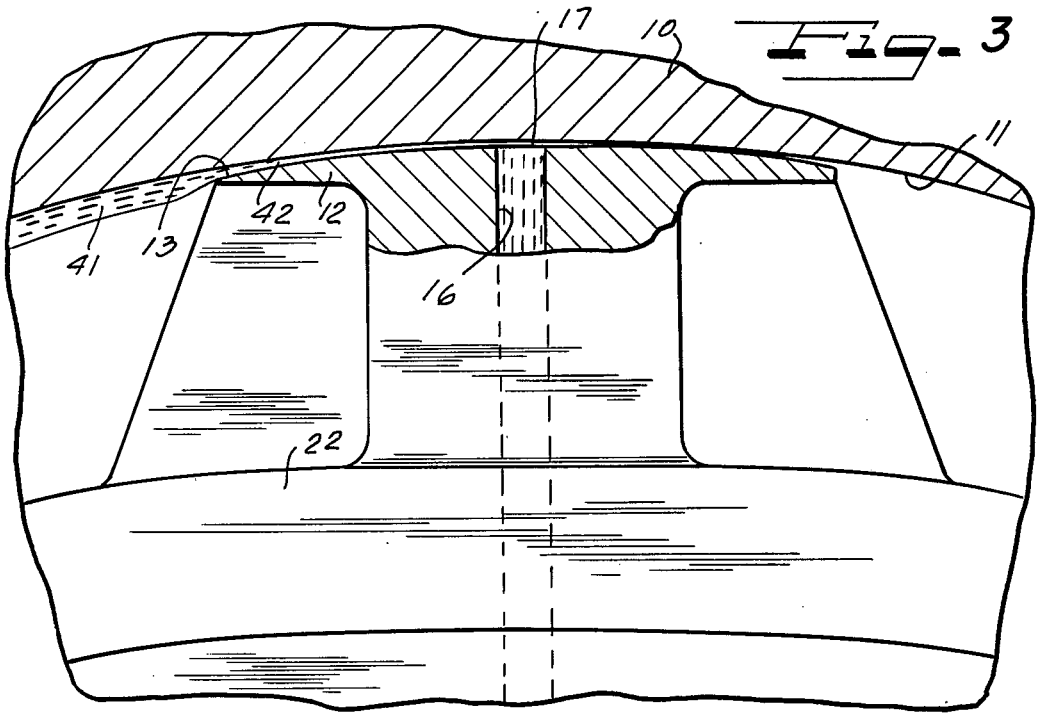
FIG. 3 is an enlarged fragmentary sectional view illustrating the coaction of one of the pumping shoes with the smooth shell surface with the liquid which is being pumped shown schematically by broken lines and with the liquid portions not necessarily shown in accurate proportionate size.

The low-volume, high-pressure liquid delivery of the pump is obtained through a passage 16 for the first shoe 12, and a passage 18 for the second shoe 14. The shoe 12 has a delivery port 17 leading into the passage 16 and the shoe 14 has a delivery port 19 leading into the passage 18 through which the liquid flows from the pressurized wedge. As illustrated in the detailed view of FIG. 3, the inner smooth surface 11 carries a thin layer of liquid such as water 41 on the surface and this liquid remains there due to rimming by centrifugal force, and means are provided to continually supply a limited amount of water to this surface.

The shoe assembly is mounted on a central stationary shaft 20, FIGS. 1 and 2. While advantages are attained in driving the shell 10 in rotation about the shoes, it would be possible to operate the mechanism by driving the shoes relatively in rotation around the surface of the shell.

The shoes 12 and 14 are supported on pivotal arms 22 and 24, respectively pivoted at 23 and 25 on a block 21 supported on the shaft. The arms 22 and 24 are pushed outwardly to control the force at which the shoes are urged against the inner smooth surface 11 and hence the output delivery pressure of the pump. For this purpose, hydraulic plungers 26 and 27 push against the moveable ends of the arms 22 and 24 and the plungers are operated by hydraulic fluid in cylinders 28 and 29 beneath the plungers. Hydraulic fluid at controlled pressure is delivered to the cylinders through radial passages 30 and 31 from axial passages 32 and 33 leading through the shaft from a hydraulic pressure supply line 34 which has a pressure control valve **34*a*** which can be adjusted to control the output pressure of the pump.

To supply water to the pump, an axial supply passage 35 leads through the stationary shaft 20 and radially out through an opening 36. Sufficient water is provided to maintain the shallow film 41, FIG. 3, against the inner surface 11 which builds up the hydraulic wedge at 42.

In addition to controlling pressure by regulating the hydraulic force used to pivot the arms and urge the shoes outwardly, the speed of rotation of the pump will change the output pressure. That is, increased speed increases the hydraulic pressure in the wedge 42 to increase the delivered pressure out through the passage 16. Also, at start-up, the force on the arms will be relieved so that no actual metal-to-metal contact will occur between the shoes and the inner surface of the shell to avoid scoring of the shell and shoe surfaces. While a relatively narrow shell and shoe are employed, as illustrated generally in FIG. 1, if a pump of increased capacity is desired, the axial width of the shoe and shell could be increased and a plurality of ports or a slot could be provided instead of the single port 17 along the working face of the shoe 12. The shoe 12 is provided with the relieved leading edge 13 and the shoe can generally be made in the shape illustrated or can be made convex of a radius of curvature smaller than the surface 11. Also, the shoe 12 can be pivotally supported on the arm so that it will assume a natural position relative to the hydraulic hydrodynamic forces being built up between the shoe and shell.

As shown in FIG. 1, the shell is constructed in the form of an annular ring and disk-shaped side plates 61 and 62 are bolted by axially extending through bolts 43 to their outer edge to the shell 10. The plates 61 and 62 have hubs 46 and 47 and within the hubs are supporting annular bearings shown at 44 and 45 for the hub 46. The hub 47 is provided with similar bearings, not shown, for rotatably supporting the shell and its carrying assembly on the stationary shaft 20. The rotary shell is driven by ring gears 48 and 59. The entire pump assembly is supported on side pedestals 53 and 54. Mounted at the base of the pedestals is a drive shaft 51 which is supported on bearings 55 and 56. The drive shaft carries gears 50 and 57 which through intermediate gear belts 49 and 58 drive the ring gears 48 and 59. It will, of course, be understood that while dual drive trains are illustrated, a single drive gearing system may be employed. The drive shaft 51 is driven by an input gear or sheave 52 which is driven by a suitable motor (not shown). Variable speed control may be provided if desired by varying speed drive at the motor or in the drive train.

In operation, water is placed in a limited amount within the shell, and the unit is brought up to a speed without applying radial outward force on the arms 22 and 24 carrying the shoes 12 and 14. When an operating speed is reached, the shoes are forced outwardly by the hydraulic members 26 and 27 and hydrodynamic wedges are built up at the leading edge of each of the shoes as shown at 42 in FIG. 3. The water is relatively incompressible so that at the high pressure developed, it flows out through the port 17 in the shoe through the passage 16 which connects through a connecting line such as 37 to a delivery line 40 leading through the shaft. The line 37 is flexible, and the other shoe is provided with a similar flexible line connecting between the passage 18 and a passage 38 leading into the shaft. A variation in hydraulic output pressure can be changed by changing the speed of rotation of the shell, and by changing the force applied to pivot the arms outwardly and hence the force with which the shoes are pressed outwardly toward the inner surface 11 of the shell 10. Thus, there has been provided a high-speed pump where there actually are no rubbing interengaging parts and the only moving parts are the outer shell which is supported on dual bearings at each side. Pressures such as needed for high-speed and high-pressure water cutting are attained through a pump which has an operating life that far exceeds pumps now available.

I claim as my invention:

1. A high-pressure liquid pump comprising in combination:

a pump shell having an annular smooth inwardly facing surface for carrying a film of liquid;

a hydraulic shoe having an outer convexly curved working face for coacting close running engagement with said shell surface;

a shoe support for positioning the shoe with its working face adjacent said annular surface;

a passage through the shoe with an entry opening in the shoe working face for conducting away high-pressure liquid from the hydraulic wedge built up between the shoe and shell surface;

and power means for driving said shell in rotation continuously moving the inwardly facing surface of the shell past the shoe and continuously forming the hydraulic wedge forcing liquid through the shoe passage at high pressure;

said shoe support including a pivotal arm supported on an axis for movement of the shoe toward and away from the pump shell surface with pressure control means connected to the pivotal arm for forcing the arm to pivot in direction to urge the shoe toward said shell surface.

2. A high-pressure liquid pump comprising in combination:

a pump shell having an annular smooth inwardly facing surface for carrying a film of liquid;

a hydraulic shoe having an outer convexly curved working face for coacting close running engagement with said shell surface;

a shoe support for positioning the shoe with its working face adjacent said annular surface;

a passage through the shoe with an entry opening in the shoe working face for conducting away high-pressure liquid from the hydraulic wedge built up between the shoe and shell surface;

power means for driving said shell in rotation continuously moving the inwardly facing surface of the shell past the shoe and continuously forming the hydraulic wedge forcing liquid through the shoe passage at high pressure;

and a pivotal arm supporting said shoe for movement toward or away from the shell surface with a hydraulic pressure member connected to the arm for urging the shoe toward the surface in accordance with the hydraulic pressure and said pressure member.

3. A high-pressure liquid pump comprising in combination:

a pump shell having an annular smooth inwardly facing surface for carrying a film of liquid;

a hydraulic shoe having an outer convexly curved working face for coacting close running engagement with said shell surface;

a shoe support for positioning the shoe with its working face adjacent said annular surface;

a passage through the shoe with an entry opening in the shoe working face for conducting away high-pressure liquid from the hydraulic wedge built up between the shoe and shell surface;

power means for driving said shell in rotation continuously moving the inwardly facing surface of the shell past the shoe and continuously forming the hydraulic wedge forcing liquid through the shoe passage at high pressure;

a stationary shaft coaxial with the shell; rotary bearings mounting the shell on the shaft;

said power means including driving gears connected to the shell;

a second shoe within the shell positioned diametrically opposite the first shoe and provided with a passage through the shell open to the second shoe face for conducting away high-pressure liquid;

a conduit through the shaft connecting with the passages for the first and second shoe;

a liquid delivery means for delivering a continuous supply of liquid to the smooth surface of the shell;

first and second pivotal arms mounted on the shaft respectively carrying said shoes;

hydraulic force members connected to the arms for urging the shoes outwardly against the shell surface for controlling the pump pressure;

and hydraulic liquid conduit means connected to the hydraulic members for delivering hydraulic fluid thereto under pressure to control the liquid output pressure of the pump.

* * * * *